US008076997B2

(12) United States Patent
Bertin et al.

(10) Patent No.: US 8,076,997 B2
(45) Date of Patent: Dec. 13, 2011

(54) CONTINOUSLY TUNABLE WAVEGUIDE DELAY LINE HAVING A DISPLACEABLE PERTURBING MEMBER

(75) Inventors: Giorgio Bertin, Turin (IT); Marco Braglia, Turin (IT); Bruno Piovano, Turin (IT)

(73) Assignees: Telecom Italia S.p.A., Milan (IT); Pirelli & C. S.p.A., Milan (IT)

( * ) Notice: Subject to any disclaimer, the term of this patent is extended or adjusted under 35 U.S.C. 154(b) by 137 days.

(21) Appl. No.: 12/227,833

(22) PCT Filed: May 31, 2006

(86) PCT No.: PCT/EP2006/005202

§ 371 (c)(1),
(2), (4) Date: Mar. 5, 2009

(87) PCT Pub. No.: WO2007/137610

PCT Pub. Date: Dec. 6, 2007

(65) Prior Publication Data

US 2009/0174500 A1 Jul. 9, 2009

(51) Int. Cl.
*H01P 1/18* (2006.01)

(52) U.S. Cl. ..... 333/159; 333/248

(58) Field of Classification Search ..... 333/159, 333/157, 239, 248

See application file for complete search history.

(56) References Cited

U.S. PATENT DOCUMENTS

| | | | | |
|---|---|---|---|---|
| 2,669,694 | A | 2/1954 | Vogeley, Jr. et al. | |
| 2,774,946 | A * | 12/1956 | McGillem et al. | 333/157 |
| 2,775,741 | A * | 12/1956 | Corbell | 333/159 |
| 2,779,003 | A | 1/1957 | Allen et al. | |
| 2,951,218 | A | 8/1960 | Arditi | |
| 3,456,355 | A | 7/1969 | Cumming et al. | |
| 3,555,232 | A | 1/1971 | Bleackley | |
| 4,613,836 | A * | 9/1986 | Evans | 333/159 |
| 4,788,515 | A | 11/1988 | Wong et al. | |
| 4,973,925 | A * | 11/1990 | Nusair et al. | 333/26 |
| 4,992,762 | A * | 2/1991 | Godshalk et al. | 333/239 |
| 5,949,303 | A | 9/1999 | Arvidsson et al. | |
| 6,075,424 | A | 6/2000 | Hampel et al. | |
| 6,441,700 | B2 | 8/2002 | Xu | |
| 6,504,450 | B2 | 1/2003 | Kim et al. | |
| 6,816,668 | B2 | 11/2004 | McDonald et al. | |
| 7,283,015 | B1 | 10/2007 | Rockenbauch | |

(Continued)

FOREIGN PATENT DOCUMENTS

GB 591369 8/1947

(Continued)

OTHER PUBLICATIONS

Yun et al., "A Low-Loss Time-Delay Phase Shifter Controlled by Piezoelectric Transducer to Perturb Microstrip Line", IEEE Microwave Guided Wave Letters, vol. 10, No. 3, pp. 96-98 (2000).

Yun et al., "Time-Delay Phase Shifter Controlled by Piezoelectric Transducer on Coplanar Waveguide", IEEE Microwave and Wireless Components Letters, vol. 13, No. 1, pp. 19-20 (2003).

Yun et al., "Analysis and Optimization of a Phase Shifter Controlled by Piezoelectric Transducer", IEEE Transactions on Microwave Theory and Techniques, vol. 50, No. 1, pp. 105-111 (2002).

(Continued)

*Primary Examiner* — Benny Lee

(74) *Attorney, Agent, or Firm* — Finnegan, Henderson, Farabow, Garrett & Dunner, L.L.P.

(57) ABSTRACT

A tunable delay line for radiofrequency applications includes a waveguide and a dielectric perturbing member that is displaceable relative to the waveguide for varying the delay imparted by the line. The waveguide is a ridge waveguide and the perturbing member is arranged parallel to a longitudinal end surface of the ridge and is movable in the ridge plane, toward and away from the ridge end surface, or in a direction transversal to the ridge.

16 Claims, 5 Drawing Sheets

U.S. PATENT DOCUMENTS

| | | | |
|---|---|---|---|
| 2002/0057136 | A1 | 5/2002 | Marketkar et al. |
| 2003/0042997 | A1 | 3/2003 | Baik et al. |
| 2004/0075967 | A1 | 4/2004 | Lynch et al. |
| 2005/0052821 | A1 | 3/2005 | Fujii et al. |

FOREIGN PATENT DOCUMENTS

| | | | |
|---|---|---|---|
| JP | 2001-68901 | | 3/2001 |
| WO | WO 89/07837 | | 8/1989 |
| WO | WO 2004/086730 | A2 | 10/2004 |
| WO | WO 2006/037364 | A1 | 4/2006 |

OTHER PUBLICATIONS

Joines, W.T, "A Continuously Variable Dielectric Phase Shifter", IEEE Transactions on Microwave Theory and Techniques, pp. 729-732 (1971).

* cited by examiner

CONTINOUSLY TUNABLE WAVEGUIDE DELAY LINE HAVING A DISPLACEABLE PERTURBING MEMBER

CROSS REFERENCE TO RELATED APPLICATION

This application is a national phase application based on PCT/EP2006/005202, filed May 31, 2006.

FIELD OF THE INVENTION

The present invention refers to delay lines, and more particularly it concerns a tunable waveguide delay line in which delay tuning is obtained by varying the position of a dielectric member within the waveguide.

Preferably, but not exclusively, the present invention has been developed in view of its use in transmitting apparatus in wireless communication systems exploiting the so-called Dynamic Delay Diversity (DDD) technique.

BACKGROUND OF THE INVENTION

A currently used technique for improving performance of wireless communication systems, in particular in downlink direction, adds a delay diversity to the space and/or polarization diversity provided by transmitting antenna arrays. In other words, different elements in the array transmit differently delayed replicas of a same signal. In case of DDD technique, the different replicas undergo time-varying delays. At a receiver, the differently delayed replicas give rise to alternate constructive and destructive combinations.

A wireless communication system exploiting the DDD technique is disclosed for instance in WO 2006/037364 A.

Use of the DDD technique entails the provision of time-varying or tunable delay lines in the signal paths towards different antenna elements.

Assuming for sake of simplicity that the signals can be considered single-frequency signals, so that applying a time delay is equivalent to applying a phase shift, a delay line with length L introduces a phase shift $\phi=\beta\cdot L$, or a delay $\tau=d\beta/d\omega$, on the signal propagating through it, $\beta$ being the propagation constant of the line and $\omega$ being the angular frequency. Thus, in order to vary the phase shift (or the delay), either $\beta$ or L is to be varied. The most commonly used solution relies on a variation of $\beta$.

Several variable phase shifters based on the variation of $\beta$ are known in the art, such lines generally relying upon the variation of the position of a dielectric member relative to a transmission line.

Variable phase shifters using microstrip transmission lines perturbed by dielectric elements are for instance illustrated in U.S. Pat. No. 6,075,424 A and U.S. Pat. No. 6,504,450 B2.

U.S. Pat. No. 6,075,424 discloses a phase shifter in which a dielectric slab is movable in the space between a transmission line and a ground plane. The slab has a width or a thickness or a dielectric constant that is variable from a leading edge to a trailing edge with reference to the direction of displacement, so that different relative positions of the slab and the line result in different values of the effective dielectric constant of the line and hence in different propagation velocities of the signal.

U.S. Pat. No. 6,504,450 discloses a phase shifter acting on a plurality of input signals. The shifter has a plurality of microstrip transmission lines shaped as concentric arcs of circumferences, and a semicircular dielectric member rotatable about an axis perpendicular to the plane of the transmission lines. The dielectric member, while rotating, covers increasing portions of each transmission line, thereby varying the phase shift induced by each of them.

In U.S. Patent Publication No. 2003/0042997 A1 and JP patent document 2001/068901 A are illustrated variable phase shifters implemented in rectangular waveguides.

U.S. Patent Publication No. 2003/0042997 Al discloses a phase shifter having an air-dielectric sandwich structure placed in a conventional rectangular waveguide. There, the dielectric constant of the structure, and hence the phase shift or the delay, is varied by varying the width of the air gap between a perturbing dielectric member and the waveguide walls.

JP patent document 2001/068901 A also discloses a phase shifter comprising a rectangular waveguide and a dielectric or metallic member partly inserted within the waveguide and movable with respect to the waveguide so that its insertion depth is changed.

SUMMARY OF THE INVENTION

The Applicant has observed that, even if the device disclosed in U.S. Pat. No. 6,075,424 A is suitable for operating in the frequency range used for wireless communications (from about 0.5 to about 5 GHz), it cannot provide the important phase (and time delay) variations required by the DDD technique when applied to mobile communication systems, such as UMTS systems. Moreover, the structure with a suspended transmission line is not suitable for the relative high powers used for instance in base stations or repeaters of a mobile communication system (typically, up to some ten watts).

As regards the device disclosed in document U.S. Pat. No. 6,504,450, use of the microstrip technology results in a very compact device, yet it renders the device unsuitable for the application to DDD, since a microstrip cannot bear the relatively high powers involved in the preferred application.

Additionally, the Applicant has also observed that in such devices implemented in conventional rectangular waveguides, even if they can tolerate the powers involved, the cut-off frequency for operation at the frequencies of interest for mobile communications is obtained only with considerable transversal sizes of the waveguide. Such considerable sizes make the device unsuitable for applications exploiting antenna diversity, where several delay lines might have to be installed in a same equipment.

Thus, the need exists for a tunable delay line which allows attaining relatively important delay variations, is capable of tolerating high signal powers and has reduced size, so that it is suitable for applications, like DDD, where a plurality of delay lines are to be used within a same apparatus.

According to a first aspect of the invention, there is provided a continuously tunable delay line, including a waveguide and a dielectric perturbing member movable within the waveguide for varying the propagation characteristics thereof and hence the delay imparted by the line, wherein the waveguide is a ridge waveguide with a longitudinally extending ridge, and the perturbing member is longitudinally arranged within the waveguide and is movable so as to vary its position relative to a longitudinal end surface of the ridge.

In a preferred embodiment of the invention, the perturbing member is displaceable parallel to itself in a longitudinal axial plane of the guide towards and away from the end surface, so as to vary the width of an air gap between the ridge and the perturbing member. The perturbing member can move through a slot formed in a waveguide wall portion facing the free end surface, or it can be mounted onto a support connected to rods movable through openings formed in the wall portion.

In another preferred embodiment of the invention, the perturbing member is displaceable parallel to itself in a direction transversal to the longitudinal axial plane of the guide, so as to vary the facing areas of opposite surfaces in the ridge and the perturbing member.

In another preferred embodiment of the invention, the perturbing member is displaceable parallel to itself in a direction transversal to said longitudinal axial plane of the guide, so as to vary the facing areas of opposite surfaces in the ridge and the perturbing member.

Use of a ridge guide allows lowering the cut-off frequency of the fundamental mode of propagation, resulting in a linear delay-versus-frequency behaviour in a range of interest and in a reduction of the size of the devices. Moreover, a ridge guide exhibits a high mechanical strength, is compatible with the relative high signal powers encountered in the preferred application and minimises ohmic loss.

In a second aspect, the invention also provides an apparatus for transmitting a signal to a plurality of users of a wireless communication system via diversity antennas, said apparatus including, along a signal path towards the diversity antennas, at least one tunable delay line generating at least one variably-delayed replica of the signal and consisting of a ridge waveguide delay line according to the invention.

In a further aspect, the invention also provides a wireless communication system including the above transmitting apparatus.

BRIEF DESCRIPTION OF THE DRAWINGS

Further objects, characteristics and advantages of the invention will become apparent from the following description of preferred embodiments, given by way of non-limiting examples and illustrated in the accompanying drawings, in which.

DESCRIPTION OF THE PREFERRED EMBODIMENTS

Figure 1:
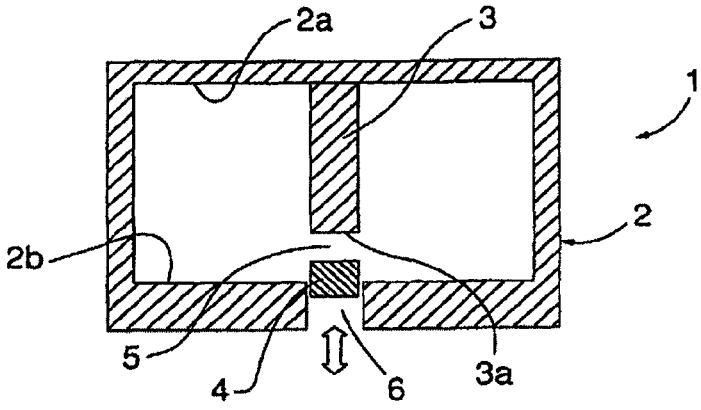
FIG. 1 is a schematic cross-sectional view explaining the basic principles of a tunable delay line according to the invention.

Referring to FIG. 1, there is schematically shown in cross sectional view the structure of a tunable delay line according to the invention, generally denoted by 1. The physical support for the delay line is a ridge guide 2, which consists of a conductive, typically metallic, waveguide with rectangular cross section having a longitudinal partition or ridge 3 extending from one wall to short distance from the opposite wall. By way of non-limiting example, the drawings show a ridge 3 vertically projecting from the upper wall or ceiling 2*a* of the guide. However, the ridge could also project from the bottom wall or from a side wall, if the guide is vertically arranged.

Figure 2A:
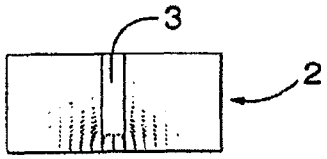
FIGS. 2A and 2B are representations of the electric field distribution in a ridge waveguide and a conventional waveguide, respectively.
Figure 2B:
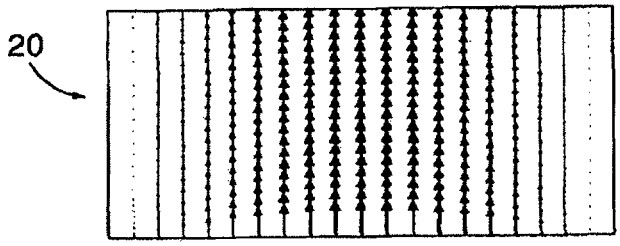
Fig. 2B PRIOR ART

As known, and as shown in FIG. 2A, the presence of a conductive ridge 3 acts so that the electric field is essentially concentrated in the region below ridge 3, instead of being distributed over substantially the whole width of the guide, as is the case for a conventional rectangular waveguide 20 (see FIG. 2B).

Taking this into account, as depicted in FIG. 1, the propagation characteristics of a ridge guide like guide 2 can be varied by introducing a dielectric perturbing member 4 in the region below ridge 3. In order to obtain a delay line whose delay can be varied in continuous and periodic manner as designated by the arrow direction herein as well as in FIGS. 5, 6 and 10 in time, perturbing member 4 must be displaceable relative to the ridge in continuous and periodic manner. In a preferred embodiment the perturbing member 4 is displaceable in a main axial plane of the ridge 3, towards and away from the end surface 3*a* of the ridge. Moving perturbing member 4 closer to or farther from ridge 3 results in a delay increase or decrease, respectively. A typical displacement frequency for perturbing member 4 could be 50 Hz. Displacement can be motor driven, or it may be obtained by piezoelectric transducers, or yet by voice coils, if important displacements are to be achieved. The means controlling the displacement are substantially conventional and are not shown in the drawings.

Perturbing member 4 is made of a dielectric material capable of resisting the signal powers envisaged in the desired application, for instance a tantalate, a niobate, alumina ($Al_2O_3$), lanthanum aluminate ($LaAlO_3$), titanium oxide ($TiO_2$), a titanate, etc. Such materials exhibit dielectric constants $\in_r$ from about 10 to about 300. Titanium oxide and titanates are preferred in that they are relatively inexpensive and exhibit high dielectric constants, so that they the desired overall delay variation can be achieved with limited displacements of perturbing member 4. This assists in making compact devices. By way of example, hereinafter reference will be made to a dielectric member made of $TiO_2$, which has a dielectric constant $\in_r$=104.

A ridge guide produces a significant lowering of the cut-off frequency of the fundamental mode of propagation, resulting in an approximately constant delay-versus-frequency behaviour in the range of interest. Lowering the cut-off frequency intrinsically implies a reduction of the size of the devices. Moreover, for a given cut-off frequency, a ridge guide has a greatly reduced cross sectional size with respect to a conventional rectangular waveguide, as it can be appreciated from FIGS. 2A and 2B which show, on the same scale, a ridge waveguide 2 and a conventional rectangular guide 20 for a cut-off frequency of 1.5 GHz.

Moreover, a ridge guide exhibits a high mechanical strength, is compatible with the relatively high signal powers encountered in the preferred use in base stations and repeaters of a mobile communication system and minimises ohmic loss.

Coming back to FIG. 1, in a first embodiment of the invention, perturbing member 4 is vertically displaceable between an uppermost position, in which it can be substantially in contact with bottom surface 3*a* of ridge 3, and a lowermost position in which it is spaced apart from that bottom surface 3*a*. Thus, an air gap 5 with periodically variable width exists between perturbing member 4 and bottom surface 3*a* of ridge 3. The variation of the width of air gap 5 determines the variation in the delay imparted by delay line 1. The vertical displacement of perturbing member 4 is permitted by a slot 6 formed in floor 2*b* of waveguide 2. As the currents on the waveguide wall propagate longitudinally, slot 6 does not significantly perturb the field lines inside the guide and hence it does not degrade the electrical performance.

Figure 3:
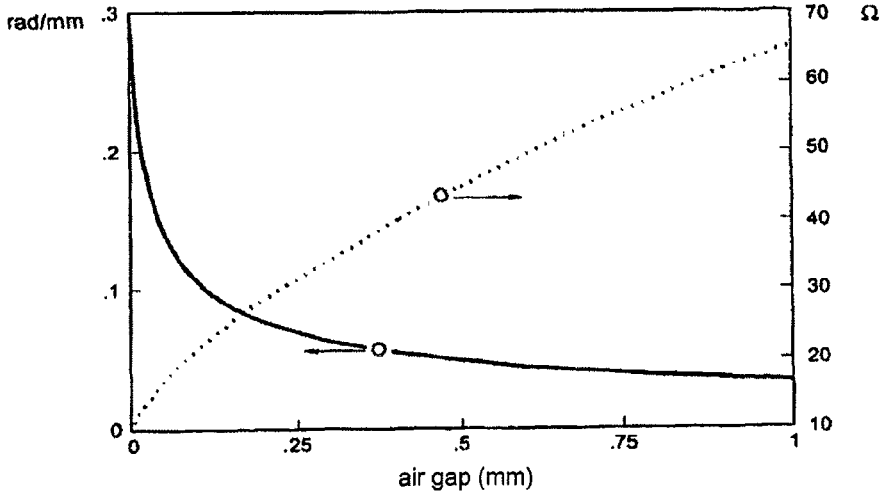
FIG. 3 are graphs of the propagation constant and the characteristic impedance of a delay line according to the invention versus the distance between the ridge and the perturbing member.
Figure 4:
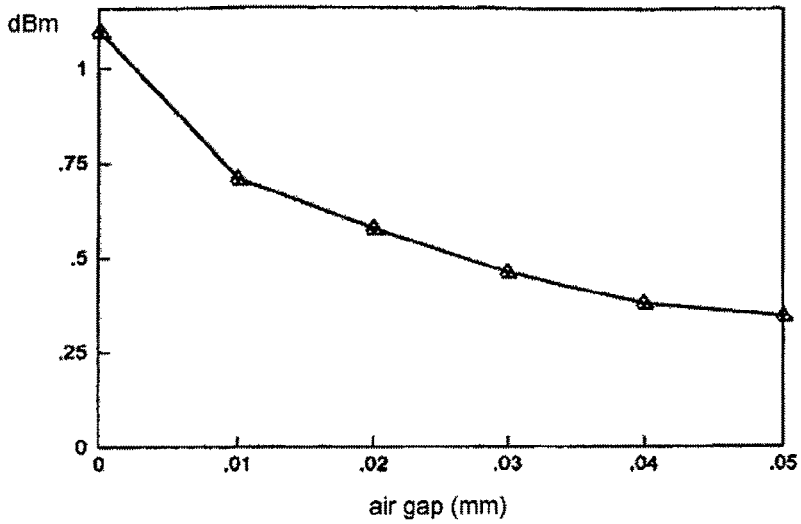
FIG. 4 is a graph of the loss of a delay line according to the invention versus the distance between the ridge and the perturbing member.

FIGS. 3 and 4 are graphs showing the influence of the displacement of perturbing member 4 on the propagation constant β, the characteristic impedance and the waveguide loss in case of a dielectric member made of $TiO_2$. The influence of the inputs and outputs has not been taken into account.

The solid line and the dotted line in FIG. 3 show respectively the behavior of propagation constant β in radiants/mm, left scale on the axis of the ordinates and the characteristic impedance $Z_0$ in ohms (Ω), right scale on the axis of the ordinates, respectively, versus the air gap width in mm on the axis of the abscissa. The graphs have been plotted under the assumption that perturbing member 4 can be displaced from 0 to 1 mm from the bottom of ridge 3. The graphs show that the propagation constant decreases as the air gap width increases, the variation being almost negligible for great air gap widths and becoming very sharp as the air gap width approaches 0 mm. On the contrary, the characteristic impedance increases in an almost linear manner as the air gap width increases, this linearity being maintained for the major part of the displacement range considered, except for air gap widths close to 0.

FIG. 4 is a graph of the losses of the delay line. The graph has been plotted considering a dielectric loss tangent tgδ=0.00025 for perturbing member 4 and a conductivity of $5.8\times10^7$ Siemens/m for ridge 3. The losses increase as dielectric member 4 approaches ridge 3, since the region below ridge 3 becomes more and more filled with dielectric material. The graph is plotted only for the air gap displacement range 0 to 0.05 mm from the bottom of ridge 3, where the loss variation is detectable. In any case, the maximum loss is lower than 1.1 dBm, such a value being considered as acceptable.

The graphs of FIGS. 3 and 4 allow an evaluation of the length required of delay line 1. A signal propagating through delay line 1 is to be delayed by a time varying delay τ(t) that is to range from 0 to the carrier period T=1/f, f being the central frequency of the signal spectrum. Such delay corresponds, for the central frequency, to a phase shift ϕ(t) ranging from 0 to 2π. It is recalled that any delay imparted to a signal with a bandwidth Δf corresponds to a phase shift linearly varying with the frequency. Denoting by L the length of delay line 1, Δβ the difference between the values of propagation constant β in two different positions of dielectric member 4 and Δϕ the corresponding differential phase shift, the following relation exists:

$$\Delta\phi=-\Delta\beta*L$$

By setting Δϕ=−2π, value L=2π/Δβ is obtained for the length of delay line 1. For instance, the curves for β and $Z_0$ show that a displacement of dielectric member 4 by only 0.05 mm from its uppermost position (in substantial contact with the bottom of ridge 3) results in a variation of β equal to about 0.145 rad/mm, so that a delay of one period is obtained by a length of about 43 mm only, considering a waveguide having internal dimensions of 36×18 mm with a ridge having a width of 4 mm and an height of 17 mm. Such variation of β corresponds to a variation of $Z_0$ of about 7 ohm.

Thus, as a conclusion, FIGS. 3 and 4 show that displacement ranges much shorter than 1 mm from the edge of ridge 3, and even much shorter than 0.5 mm, can be used for perturbing member 4. However, care should be taken in choosing the uppermost position of perturbing member 4. Actually, on the one hand a displacement range closer to the ridge allows a required delay variation to be obtained with shorter displacements of perturbing member 4, which assists in obtaining compact structures; on the other hand this would result in a stronger variation of the characteristic impedance and in a loss increase.

Figure 5:
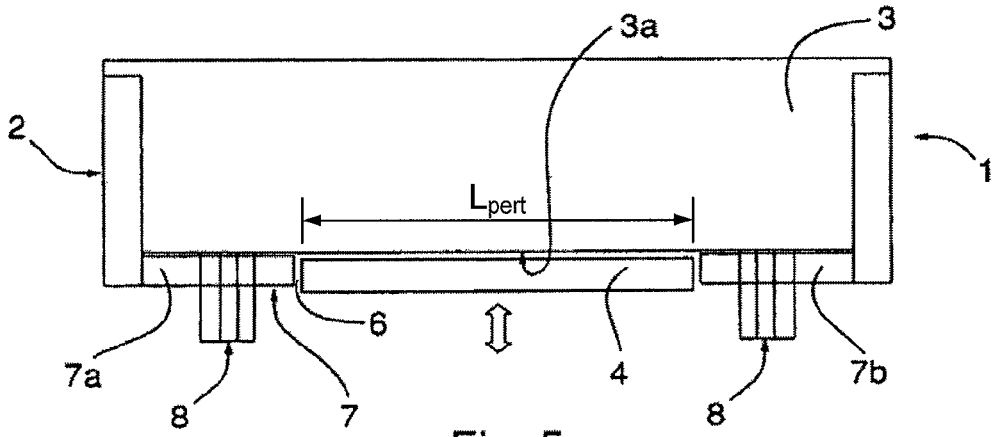
FIG. 5 is a longitudinal cross-sectional view of a first embodiment of the invention.

FIG. 5 is a longitudinal cross-section of a first practical construction of a delay line 1 with a perturbing member 4 vertically displaceable through a slot 6. The same reference numerals as in FIG. 1 are used to indicate like parts. Movable perturbing member 4 is the central part of a dielectric body 7 that, in order to obtain a good matching, extends over the whole ridge length. End portions 7*a*, 7*b* of dielectric body 7 are stationary and, in correspondence with such stationary portions 7*a*, 7*b*, vertically extending connectors 8 are provided for connection of coaxial cables forming the input/output ports of the guide. Connectors 8 are so constructed that, in each cable, the central conductor is directly connected to ridge 3 and the outer conductor is electrically connected to the structure of guide 2. In such a construction, the attainable delay is in first approximation proportional to length $L_{pert}$ of perturbing member 4.

Such a configuration ensures an optimum mechanical robustness and low electric losses.

Figure 6:
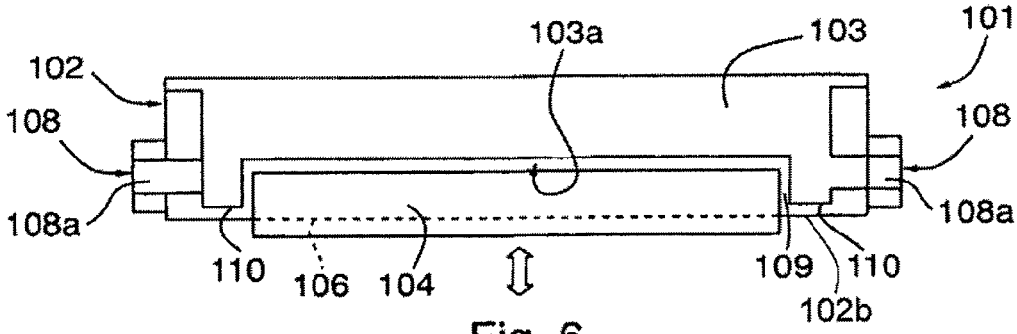
FIG. 6 is a longitudinal cross-sectional view of a second embodiment of the invention.

FIG. 6 shows a delay line 101 that differs from delay line 1 shown in FIG. 5 with respect to of the construction of the perturbing member and of the transition between the guide and the input/output coaxial cables. Elements corresponding to those shown in FIG. 5 are denoted by like references, in a series beginning with reference numeral 101 In FIG. 6, perturbing member 104 is still vertically displaceable through a slot 106 in guide floor 102*b*, but it has almost the same length as ridge 103 and forms the whole of the dielectric body mounted in waveguide 102. Ridge 103 has, in its bottom surface 103*a*, a longitudinal recess 109 defined by two downward-extending projections 110 and receiving perturbing member 104 during at least the upper part of its displacement. Furthermore, the input/output coaxial cables are connected to waveguide 102 through connectors 108 that longitudinally project from waveguide 102. Connectors 108 are still constructed so that the central conductor of the respective coaxial cable can be directly connected to ridge 103 and the external conductor can be electrically connected to the waveguide structure. The inner cavity 108*a* of each connector 108 ends at a corresponding projection 110 of ridge 103.

The construction still affords the advantages of mechanical robustness and has the advantage of being simpler than that shown in FIG. 5. A further advantage is that the longitudinal connection of the coaxial cables eliminates the need for the stationary portions 7*a*, 7*b* (FIG. 5) where connectors 8 are mounted, so that perturbing member 104 (FIG. 6) can extend over almost the whole length of the ridge: thus, either a reduced displacement range is necessary for attaining a desired maximum delay or a higher delay can be obtained for a same overall displacement.

Figure 7:
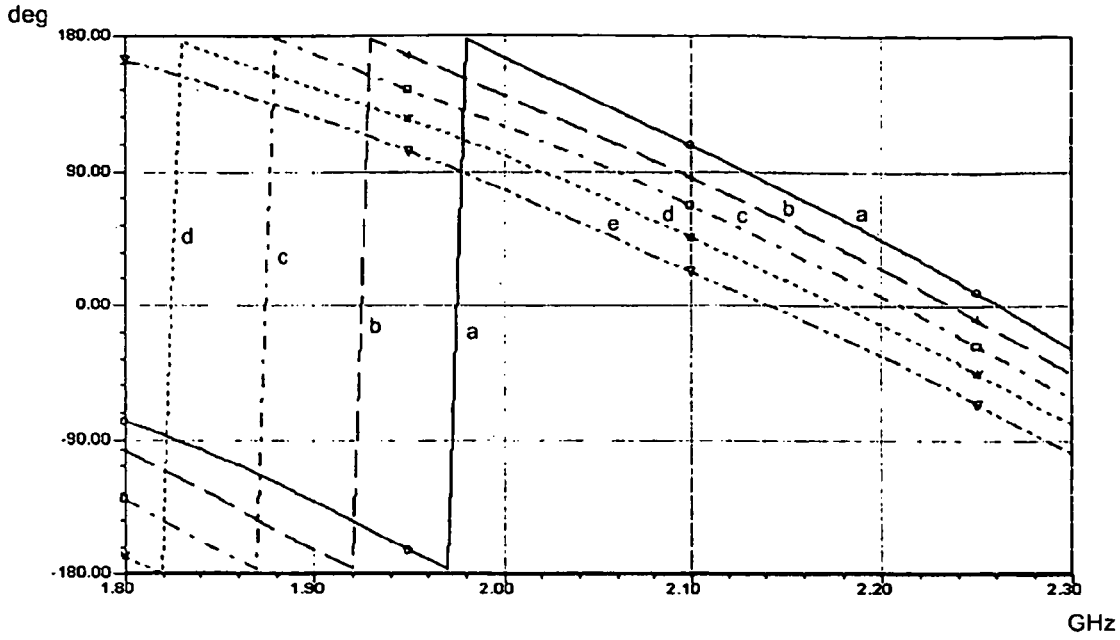
FIGS. 7, 8, 9 are graphs of the phase shift, the return loss and the insertion loss, respectively, versus frequency, for different relative positions of the ridge and dielectric member in the delay line of FIG. 6.
Figure 8:
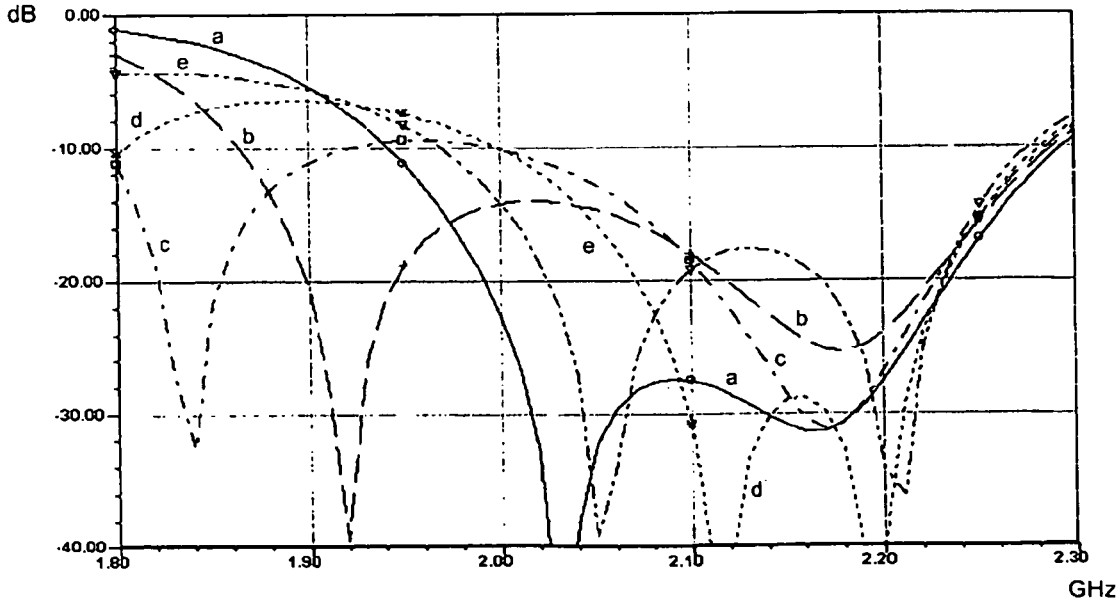
Figure 9:
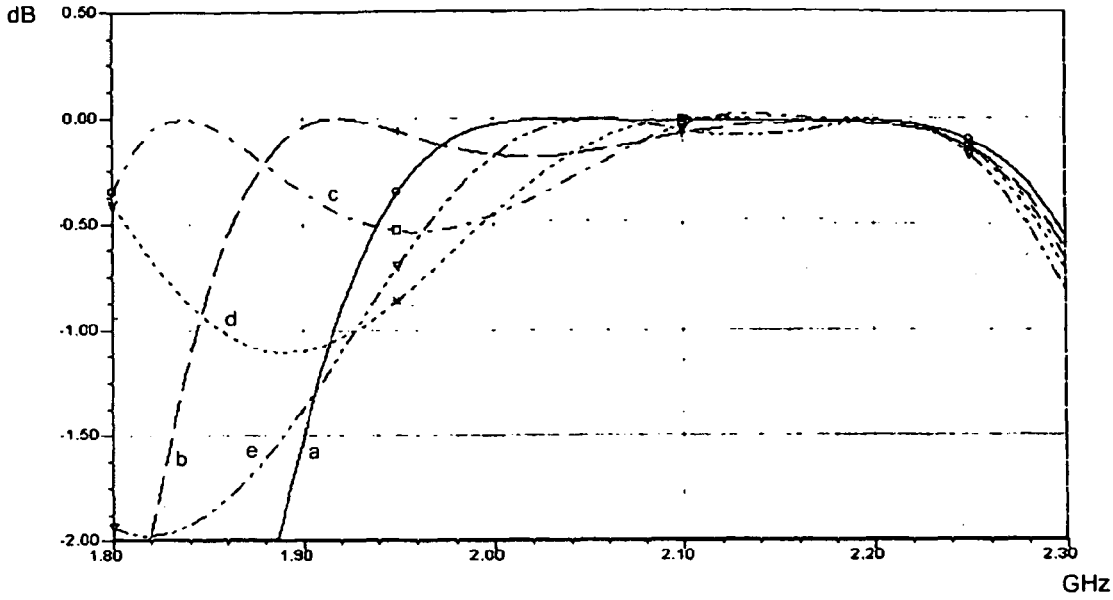

FIGS. 7 to 9 are graphs of the performance of delay line 101 of FIG. 6, for different positions of perturbing member 104. The graphs have been plotted assuming a length of the perturbing member $L_{pert}$=40 mm and a displacement range of 0.2 mm for perturbing member 104, between uppermost and lowermost positions spaced by 0.3 mm and 0.5 mm, respectively, from bottom surface 103*a* of ridge 103. More particularly, solid line curve a refers to the lowermost position of perturbing member 104, dashed line curve b refers to a spacing of 0.45 mm between perturbing member 104 and ridge 103, dash-and-dot line curve c to a spacing of 0.4 mm, dotted line curve d to a spacing of 0.35 mm and dash-and-double dot line curve e to the uppermost position of perturbing member 104.

FIG. 7 shows the differential phase shift (in degrees) between input and output ports 108 versus frequency (in GHz). The curves show a substantially linear behavior of the phase shift versus frequency. As shown, an overall displacement of 0.2 mm allows attaining a differential phase shift of about 90° (i.e. a delay tuning by about T/4) over the whole downlink band of the UMTS system (about 2.11 to about 2.17 GHz). Wider tuning ranges for the delay can be obtained by increasing either the displacement range for perturbing member 104 or the input-output distance (i.e. the line length). Some considerations in this respect will be made further on.

FIG. 8 shows that the return loss is strongly dependent on the position of perturbing member 104. In any case, with the considered displacement range, it can be seen that the return loss in dB vs. frequency in GHz is better than about 15 dB over the whole downlink band of the UMTS system.

In FIG. 9, the insertion loss in dB vs. frequency in GHz has been calculated by taking into account the loss of the dielectric ($TiO_2$) and of the waveguide metal (copper). FIG. 9 shows that the insertion loss is less than 0.2 dB over the whole downlink band of the UMTS system and has a limited dependence, in such band, on the position of perturbing member 104.

As noted above, to obtain greater delays than those considered in the above discussion, either the displacement range of perturbing member 104 or the length of delay line 101 (substantially coinciding with that of perturbing member 104) should be increased. Yet, an increase of the overall displacement range results in greater distances from a position of perturbing member 104 for which the line parameters have been optimized and thus in greater mismatch. Increasing the delay line length of course affects the compactness of the device.

Figure 10:
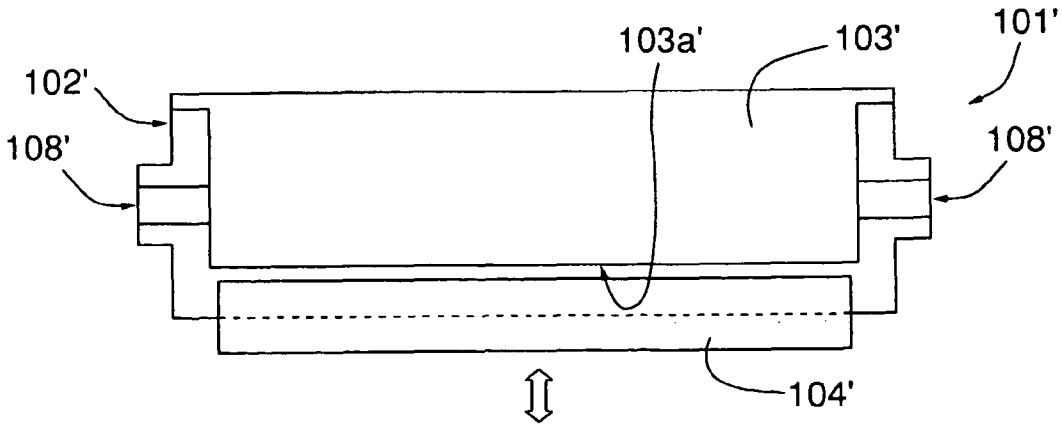
FIG. 10 is a longitudinal cross-sectional view of part of a variant of the delay line shown in FIG. 6.

In the variant delay line 101' shown in FIG. 10, ridge 103' of waveguide 102' has no projection like projections 110 of FIG. 6, and hence no recess is formed in bottom surface 103*a'* of ridge 103'. Hence, perturbing member 104' has actually the same length as ridge 103'. The advantages of a greater length of the perturbing member are further enhanced.

Figure 11:
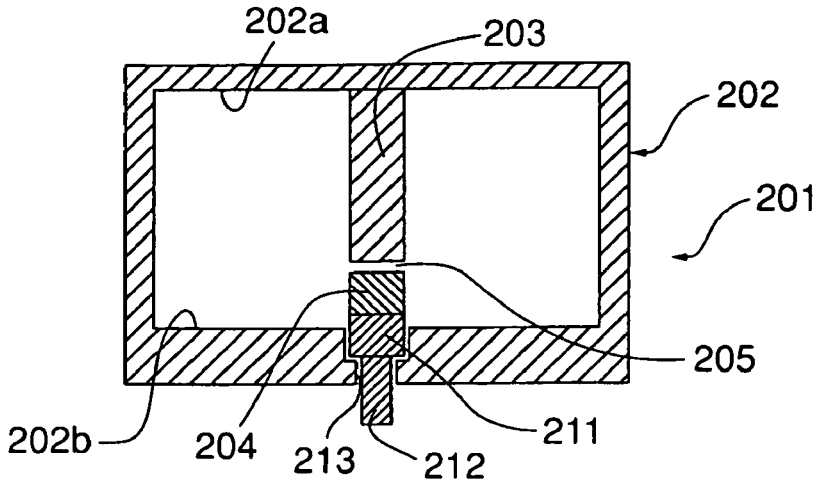
FIG. 11 is a schematic cross-sectional view of a third embodiment of the invention.

In the embodiment shown in FIG. 11, where elements corresponding to those shown in the previous Figures are denoted by like references, in a series starting with 201, waveguide 202 has an upper wall or ceiling 202*a*. Delay line 201 still has a vertically movable dielectric perturbing member 204 separated from ridge 203 by air gap 205. Member 204 however, instead of being movable through a slot in guide floor 202*b*, is supported by a metal body 211 connected to a pair of rods 212 (only one being shown in the drawing) that are connected to the displacement control members and are vertically displaceable through respective openings 213 in guide floor 202*b*. That solution minimizes the overall area of the passages formed in guide floor 202*b* and consequently current interruption. That solution can be adopted for both the construction with vertical connectors 8 (FIG. 5) and that with longitudinal connectors 108, 108' (FIGS. 6, 10), respectively. A single rod could even be used.

Figure 12:
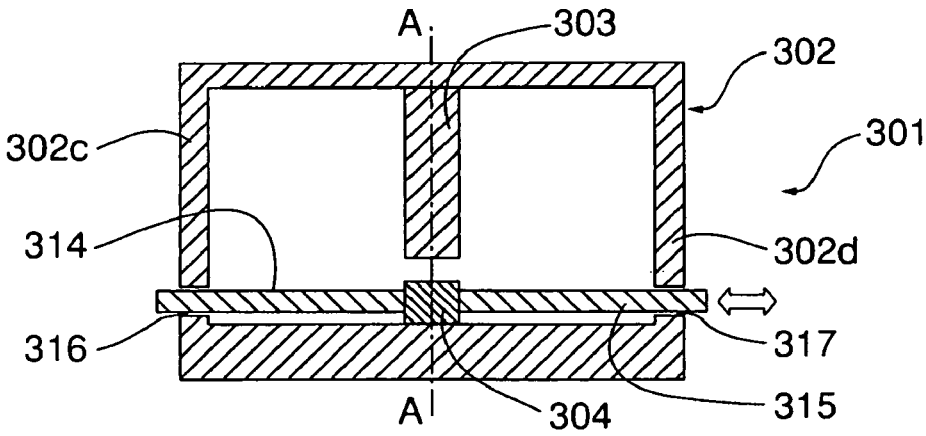
FIG. 12 is a schematic cross-sectional view of a fourth embodiment of the invention.

In the embodiment shown in FIG. 12, delay line 301 includes a dielectric perturbing member 304 that is horizontally displaceable in a direction transverse to the longitudinal extension of ridge 303, so that the different delays correspond to different relative positions of dielectric member 304 relative to longitudinal axial plane A-A of ridge guide 302. Dielectric member 304 is secured (e.g. glued) to dielectric rods 314, 315 made of a material with lower permittivity than dielectric member 304 and low loss. The rods 314, 315 are connected to the displacement control members and are horizontally displaceable through respective openings 316, 317 in longitudinal side walls 302*c*, 302*d* of guide 302. This embodiment also minimizes the area of passages formed in guide 302. A single rod could even be used.

Figure 13:
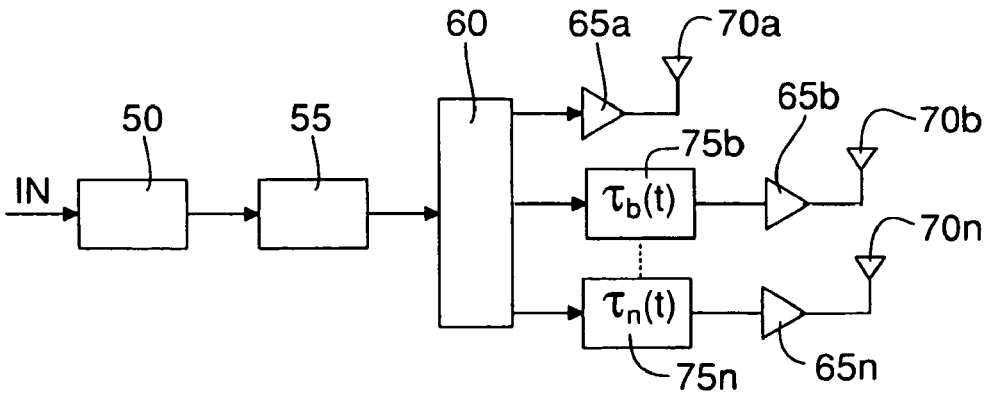
FIG. 13 is a schematic block diagram of a transmitting apparatus of a wireless communication system with dynamic delay diversity, using delay lines according to the invention.

FIG. 13 schematically shows a transmitter of a wireless communication system using dynamic delay diversity, like the system disclosed in the above mentioned WO 2006/037364 A. The transmitter can be employed in base stations, repeaters or even mobile stations of the system. Here, an input signal IN is fed to a base-band block 50 that outputs a base-band version of signal IN. The base-band signal is fed to an intermediate-frequency/radio-frequency block 55 connected to a signal splitter 60, which creates two or more signal replicas by sharing the power of the signal outgoing from block 55 among two or more paths leading, possibly through suitable amplifiers 65*a*, 65*b* . . . 65*n*, to respective antenna elements 70*a*, 70*b* . . . 70*n*. The first path is shown as an undelayed path, whereas respective tunable delay lines 75*b* . . . 75*n* according to the invention are arranged along the other paths, each line 75*b* . . . 75*n* delaying the respective signal replica by a time varying delay $\tau_b(t) \ldots \tau_n(t)$. The delay variation law may be different for each line. A delay line could be provided also along the first path. The tuning control members are included within the delay lines for sake of simplicity of the drawing.

It is clear that the above description has been given by way of non-limiting example and that the skilled in the art can make changes and modifications without departing from the scope of the invention.

The invention claimed is:

1. A continuously tunable delay line, comprising a waveguide and a dielectric perturbing member that is continuously displaceable relative to the waveguide by displacement driving units for varying the delay imparted by the delay line, said waveguide comprising a longitudinally extending ridge having an end surface, and said perturbing member being arranged in the waveguide, wherein said perturbing member is mounted onto a support secured to one or more rods extending through openings disposed in a waveguide wall opposite to said end surface of the ridge and connected to said driving units for displacing said perturbing member toward and away from said end surface, wherein said perturbing member is displaceable between a position in which said perturbing member is substantially adjacent to said end surface of the ridge and a position in which said perturbing member is spaced by at most 1 mm from said end surface.

2. The continuously tunable delay line as claimed in claim 1, wherein said support and said one or more rods comprise metal.

3. The continuously tunable delay line as claimed in claim 1, wherein said perturbing member comprises a dielectric selected from tantalates, niobates, alumina, lanthanum aluminate, titanium oxide and titanates.

4. The continuously tunable delay line as claimed in claim 1, wherein said ridge has a recess in said end surface thereof, said recess being defined by lateral end projections of the ridge and being arranged to receive said perturbing member during at least part of the displacement of said perturbing member.

5. The continuously tunable delay line as claimed in claim 1, wherein said perturbing member is a longitudinally central portion of a dielectric body extending over substantially an entire ridge length and comprising stationary portions adjacent to both ends of the perturbing member.

6. The continuously tunable delay line as claimed in claim 5, wherein the continuously tunable delay line comprises, in a region of said stationary portions, input/output connectors for coaxial cables extending in a direction parallel to a displacement direction of the perturbing member.

7. The continuously tunable delay line as claimed in claim 1, wherein said perturbing member is displaceable between two end positions spaced by 0.1 mm and 0.5 mm, respectively, from said end surface of the ridge.

8. A continuously tunable delay line, comprising a waveguide and a dielectric perturbing member that is continuously displaceable relative to the waveguide by displacement driving units for varying the delay imparted by the delay line, said waveguide comprising a longitudinally extending ridge having an end surface, and said perturbing member being arranged in the waveguide, wherein said perturbing member is mounted onto a support secured to one or more rods extending through openings disposed in a waveguide wall opposite to said end surface of the ridge and connected to said driving units for displacing said perturbing member toward and away from said end surface, wherein said movable perturbing member extends over substantially an entire ridge length, and wherein the continuously tunable delay line comprises input/output connectors for coaxial cables extending from opposite ends of the waveguide.

9. The continuously tunable delay line as claimed in claim 8, wherein said input/output connectors are constructed so as to allow direct connection of a respective central conductor of a corresponding coaxial cable to the ridge, and a respective electrical connection of an external conductor of a corresponding coaxial cable to a waveguide structure.

10. A method for applying a continuous tunable delay to a signal by means of a waveguide, comprising:

arranging a longitudinally extending ridge in said waveguide;

arranging a dielectric perturbing member extending longitudinally to said ridge, said perturbing member being mounted onto a support secured to one or more rods extending through openings in a wall of said waveguide; and moving said perturbing member so as to vary a position of said perturbing member parallel to an end surface of the ridge.

11. The method of claim 10, wherein said perturbing member comprises a dielectric selected from tantalates, niobates, alumina, lanthanum aluminate, titanium oxide and titanates.

12. A continuously tunable delay line, comprising a waveguide and a dielectric perturbing member that is continuously displaceable relative to the waveguide by displacement driving units for varying the delay imparted by the delay line, said waveguide comprising a longitudinally extending ridge having an end surface, and said perturbing member being arranged in the waveguide, wherein said perturbing member is displaceable parallel to said end surface of the ridge, wherein said perturbing member is secured to at least one displaceable rod, which extends through at least one opening formed in a waveguide wall portion opposite to the end surface of the ridge and is connected to drive members of said driving units for controlling displacement of said perturbing member, and wherein said at least one rod comprises a dielectric different from the dielectric of the perturbing member.

13. The continuously tunable delay line as claimed in claim 12, wherein said perturbing member comprises a dielectric selected from tantalates, niobates, alumina, lanthanum aluminate, titanium oxide and titanates.

14. The continuously tunable delay line as claimed in claim 12, wherein said at least one rod comprises a dielectric with lower permittivity than the dielectric of said perturbing member and is of low loss.

15. An apparatus for transmitting a signal to a plurality of users of a wireless communication system via diversity antennas, said apparatus comprising, along a signal path toward said diversity antennas, at least one tunable delay line for generating at least one replica of said signal delayed by a time varying delay, said tunable delay line being a ridge waveguide continuously tunable delay line, the continuously tunable delay line comprising said ridge waveguide and a dielectric perturbing member that is continuously displaceable relative to the waveguide by displacement driving units for varying the delay imparted by the delay line, said waveguide comprising a longitudinally extending ridge having an end surface, and said perturbing member being arranged in the waveguide and being movable so as to vary the position of the perturbing member relative to the end surface of the ridge.

16. A wireless communication system comprising a transmitting apparatus as claimed in claim 15.

* * * * *